US005877666A

United States Patent [19]

Johnson, Jr. et al.

[11] Patent Number: 5,877,666

[45] Date of Patent: Mar. 2, 1999

[54] STACKABLE, PASSIVELY-TUNABLE, COST-REDUCED INDUCTOR

[75] Inventors: David Wilfred Johnson, Jr., Bedminster, N.J.; David A. Norte, Westminster, Colo.; John Thomson, Jr., Spring Lake, N.J.

[73] Assignee: Lucent Technologies Inc., Murray Hill, N.J.

[21] Appl. No.: 815,618

[22] Filed: Mar. 12, 1997

[51] Int. Cl.[6] ..... H01F 27/28; H01F 17/30

[52] U.S. Cl. ..... 336/180; 336/200; 336/184; 336/206; 336/229

[58] Field of Search ..... 336/200, 229, 336/180, 184, 222, 206, 196

[56] References Cited

U.S. PATENT DOCUMENTS

| | | | |
|---|---|---|---|
| 3,833,872 | 9/1974 | Marcus et al. | 336/83 |
| 5,572,180 | 11/1996 | Huang et al. | 336/200 |
| 5,576,680 | 11/1996 | Ling | 336/200 |

FOREIGN PATENT DOCUMENTS

| | | | |
|---|---|---|---|
| 58-078402 | 12/1983 | Japan | H01F 17/04 |
| 2-102512 | 4/1990 | Japan | 336/229 |
| 2-298005 | 12/1990 | Japan | 336/184 |
| 2-298005A | 12/1990 | Japan | 336/184 |
| 4-101404 | 4/1992 | Japan | 336/196 |
| 06061055 | 4/1994 | Japan | H01F 17/00 |
| 6-168831 | 6/1994 | Japan | 336/200 |
| 6-168831-A | 6/1994 | Japan | 336/200 |

*Primary Examiner*—Michael L. Gellner
*Assistant Examiner*—Anh Mai
*Attorney, Agent, or Firm*—David Volejnicek

[57] ABSTRACT

An inductor (100) optimized for surface-mount vacuum-pickup automated circuit assembly eliminates the expense of an inductor housing. The inductor has a hollow rectangular ferrite core (101) and a winding defined by a stripline (102) deposited on the core surface. Winding ends are formed by conductive vias (103) in the core that open onto the core surface, where they connect and mount the inductor to a circuit board (150). A flat sheet (104) adhered to one face of the core provides a surface for vacuum pickup and for labeling of the inductor. The core of a passively tuneable inductor (200) defines multiple unconnected winding segments (102–103). Segment ends mount the inductor to the circuit board and connect the segments to circuit board striplines (254) that are laid out in a pattern to interconnect a number of the segments into a winding. The inductor is tuned by changing the stripline layout and thereby varying the number of interconnected segments. The core of an electromagnetic interference choke (300) defines two windings wound axially in parallel and radially in opposite directions. The core of a choke (500) that permits stacked mounting defines additional conductive vias (503) for connecting the windings of a second choke (300) mounted on the core to the circuit board. For electromagnetic isolation, the windings of the two chokes are oriented orthogonally to each other.

16 Claims, 4 Drawing Sheets

STACKABLE, PASSIVELY-TUNABLE, COST-REDUCED INDUCTOR

CROSS-REFERENCE TO RELATED APPLICATIONS

This application relates to an application by the same inventors entitled "Stackable and Cost-Reduced Transformer With Embedded EMI Filters" Ser. No. 08/820,325, filed on Mar. 18, 1997 and assigned to the same assignee.

TECHNICAL FIELD

This invention relates generally to the configuration of components adapted for printed circuit (PC) board assembly, and specifically to inductors adapted for surface-mount automatic PC board assembly.

BACKGROUND OF THE INVENTION

A widely-used device on PC boards is a ferrite toroid—a cylinder of ferrite material. With a wire looped several times through the toroid, the toroid is used as a fixed-impedance inductor. A technological challenge is to produce a ferrite inductor suitable for surface-mounting on a PC board without significantly adding to the cost of the toroid itself. Present designs of surface-mountable ferrite inductors result in a total cost that is about 20 times the cost of the toroid itself. Most of this cost is due to the housing for the toroid that makes the inductor suitable for automated surface-mount circuit assembly.

SUMMARY OF THE INVENTION

This invention is directed to solving these and other problems and disadvantages of the prior art. According to the invention, an inductor dispenses with a housing. The inductor comprises a ferrite core which defines on its surface a conductive winding. Ends of the winding are also defined by the surface, and they serve to connect and to mount the inductor to a circuit board. Since the core itself defines the connection to the winding and to the circuit board, an inductor housing is not needed for this purpose. The need for a housing is thus eliminated, and with it much of the inductor cost.

Preferably, the core surface defines a plurality of mutually unconnected conductive winding segments. The segments have their ends also defined by the surface, and serve to mount the inductor to the circuit board and to connect the segments to striplines, defined by the circuit board, which are laid out in a pattern such that they interconnect a desired number of the winding segments of the mounted inductor to form therewith the inductor winding. The number of interconnected winding segments is changed by changing the stripline layout on the circuit board, and the inductor is passively tuned thereby.

The inductor is caused to function as a filter—illustratively as an electromagnetic interference choke—by defining on the core surface a pair of conductive windings radially wound in opposite directions—one clockwise and the other counter-clockwise. The ends of the windings again serve to connect and to mount the filter to the circuit board, where the windings preferably connect to different signal striplines. The opposite radial orientation of the windings advantageously suppresses common mode interference between the signal striplines.

Preferably, the filter is adapted for stacked mounting of a plurality of the filters, thereby to conserve circuit board real estate. For this purpose, the ferrite core of a first filter defines additional conductive vias, which serve to connect ends of the windings of a second filter mounted on the ferrite core of the first filter to the circuit board. These additional vias are positioned such that the windings of the second filter are positioned orthogonally to the windings of the first filter when the second filter is mounted on the first filter and connected to the additional vias.

These and other advantages and features of the invention will become more apparent from the following description of illustrative embodiments of the invention taken together with the drawing.

DETAILED DESCRIPTION

Figure 1:
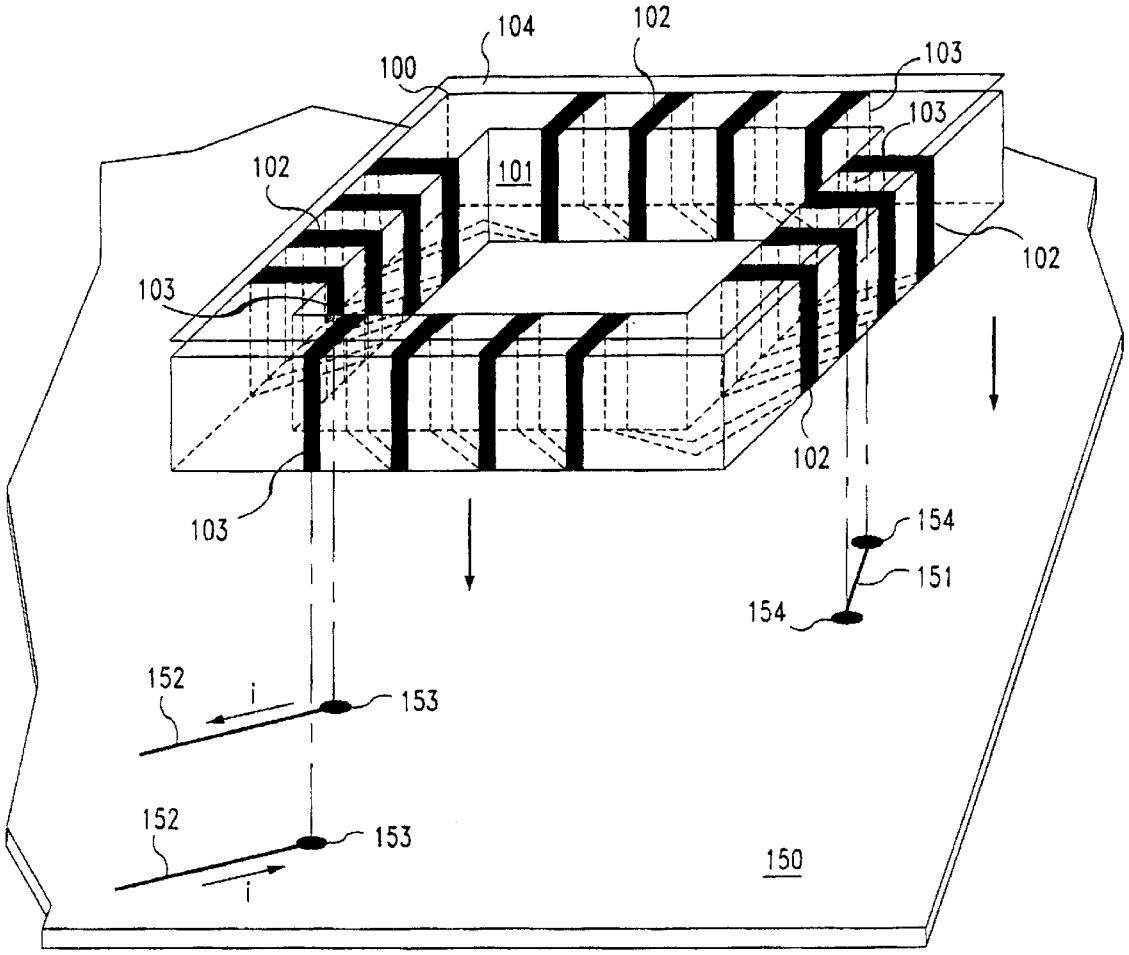
FIG. 1 is an exploded perspective view of a PC board surface-mounted ferrite inductor implementing a first illustrative embodiment of the invention.

FIG. 1 shows a ferrite inductor 100 constructed according to the invention and surface mounted on a PC board 150. Ferrite inductor 100 comprises a non-conductive ferrite core that is shaped like a hollow rectangle or square, and is referred to herein as a squareoid 101. This shape is optimized for ease of mass-production, but other shapes (e.g., ellipses, rings, etc.) may be used as well. Inductor wiring is implemented in ferrite inductor 100 by plating or otherwise depositing conductive (e.g., copper) vias or striplines 102 directly onto all surfaces of squareoid 101, by using multilayer magnetic technologies. All of the striplines 102 are connected together to form a single inductor winding having multiple turns—16 in the illustrative example shown in FIG. 1.

Four metallized electrical vias 103 are partially embedded within squareoid 101 to facilitate the surface mounting of ferrite inductor 100 to landing pads 153 and 154 of PC board 150. Landing pads 153 and 154 are located at opposite corners of the mounting position of squareoid 101. Landing pads 153 are connected to striplines 152 of PC board 150 for conducting current to and from ferrite inductor 100. Landing pads 154 are connected together by a stripline 151 and serve simply to physically attach squareoid 101 to PC board 150. A flat paper or a plastic sheet 104 may be adhered (glued) to a top surface of squareoid 101. Sheet 104 provides both a surface for carrying a label of ferrite inductor 100 as well as a surface for pickup and placement of ferrite inductor 100 on PC board 150 via vacuum pickup and placement automated circuit assembly machines. Following placement of ferrite inductor 100 on PC board 150, vias 103 are soldered to landing pads 153 and 154 by using conventional solder reflow techniques.

Because this configuration of ferrite inductor 100 dispenses with housing or packaging (other than, perhaps, sheet 104) to adapt the ferrite inductor for surface-mount automated circuit assembly, it is estimated to reduce the ferrite inductor's cost to about one-tenth of the cost of present ferrite inductors.

Figure 2:
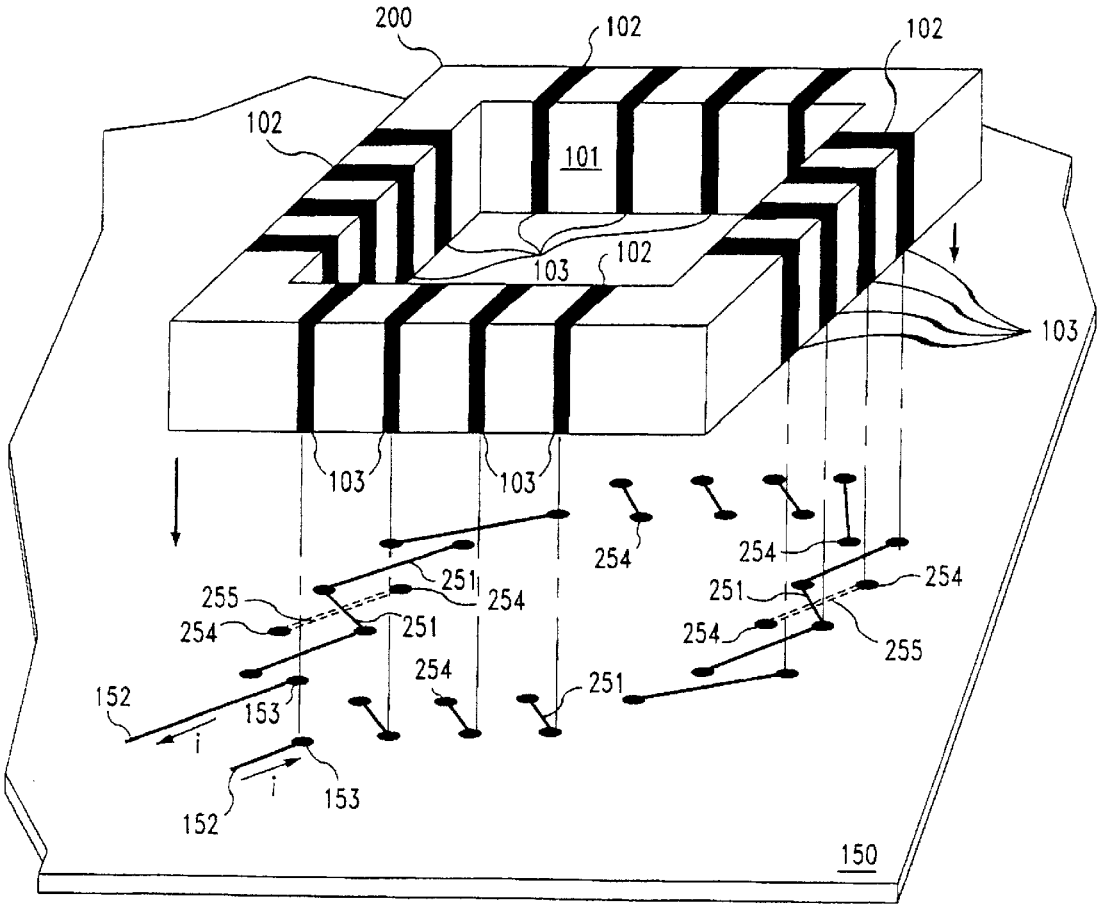
FIG. 2 is an exploded perspective view of a PC board surface-mounted passively-tunable ferrite inductor implementing a second illustrative embodiment of the invention.

FIG. 2 shows a modification of the PC-mounted ferrite inductor of FIG. 1 to make it passively tuneable. Ferrite inductor 200 of FIG. 2 again comprises a squareoid 101 with striplines 102 deposited on its top surface. However, those striplines 102 on the surfaces of squareoid 101 that are perpendicular to PC board 150 in FIG. 1 are all replaced in FIG. 2 with metallized electrical vias 103, and those striplines 102 that are on the bottom surface of squareoid 101 in FIG. 1 are eliminated in FIG. 2. Hence, in FIG. 2, striplines 102 and vias 103 no longer form a single winding of 16 turns, but rather form 16 discrete "U"-shaped winding segments. Interconnections between the "U"-shaped winding segments are made by landing pads 254 and striplines 251 defined by PC board 150. All vias 103 extend to, and even with, the bottom surface of squareoid 101. This makes inductor 100 well suited for surface-mount PC board assembly. The legs (vias 103) of the "U"-shaped winding segments are positioned to contact landing pads 153 and 254 and then are soldered thereto by conventional solder reflow techniques. As shown in FIG. 2, two of the "U"-shaped winding segments are left out of the inductor winding produced by the striplines 251 of PC board 250, thereby producing a 14-turn winding. However, if striplines 255 shown in dashed lines in FIG. 2 were to replace the two striplines 251 which they cross, all of the "U"-shaped winding segments defined by squareoid 100 would be included in the inductor winding. It is therefore evident that, by varying the pattern of striplines 251 and thereby varying the number of "U"-shaped winding segments that are connected together to form the inductor winding, ferrite inductor 200 is passively tuned. The same effect is achieved by connecting one or both striplines 152 to different ones of the landing pads 254 instead of to landing pads 153, thereby excluding one or more of the "U"-shaped segments from the inductor winding.

Figure 3:
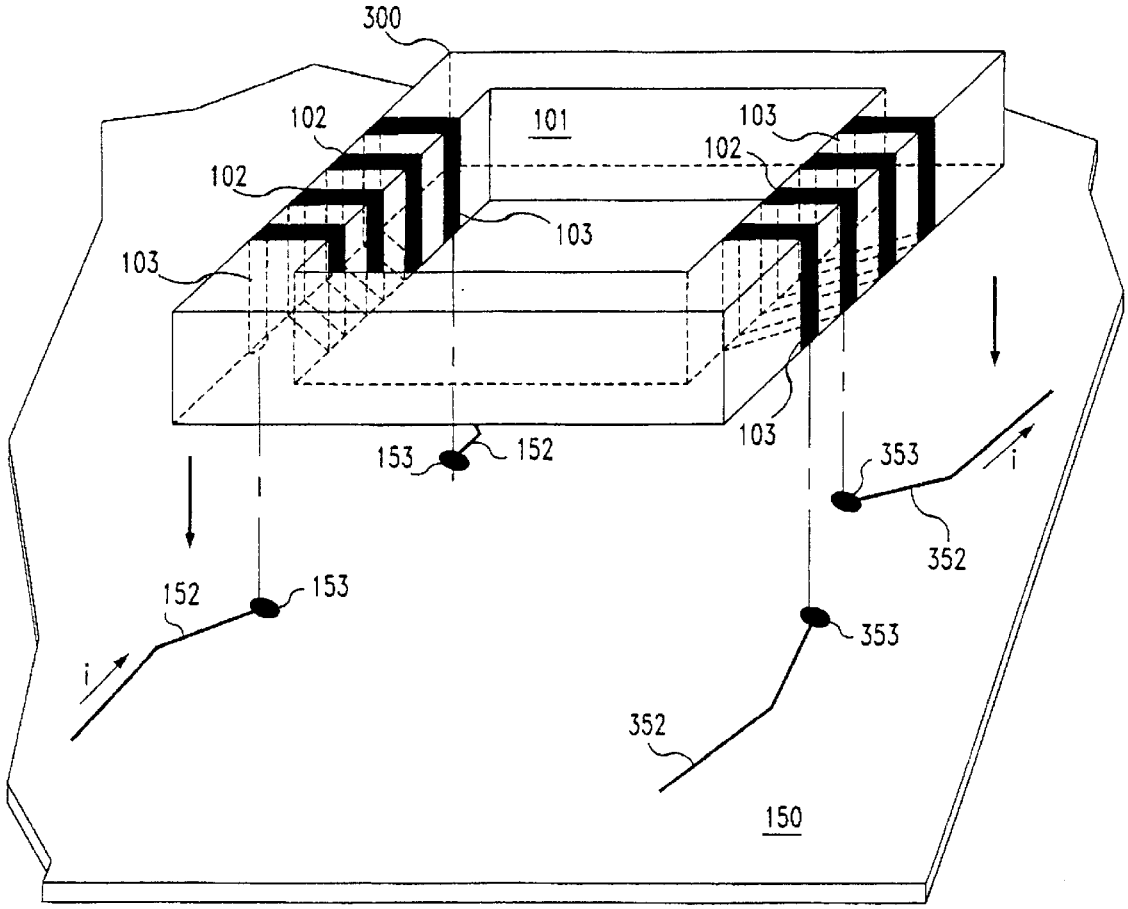
FIG. 3 is an exploded perspective view of a PC board surface-mounted ferrite choke implementing a third illustrative embodiment of the invention.

FIG. 3 shows a ferrite inductor implementation wherein the inductor is configured to act as an electromagnetic interference (EMI) choke 300. Choke 300 comprises a squareoid 101 with striplines 102 deposited on all surfaces of a pair of opposite sides of squareoid 101. Striplines 102 form two inductive windings, one around each of the opposite sides. The windings are wound in opposite directions—one clockwise, and the other counter-clockwise. Each end of each winding terminates in a metallized electrical via 103. PC board 150 defines two pairs of landing pads 153 and 353, each pair for attachment to vias 103 of a different one of the windings. Striplines 152 connect to landing pads 153 and conduct current to and from one of the windings, while striplines 352 connect to landing pads 353 and conduct current to and from the other of the windings. The current flow in the same axial but opposite radial directions through the two windings creates an impedance that suppresses common-mode interference between striplines 152 and 352.

Figure 4:
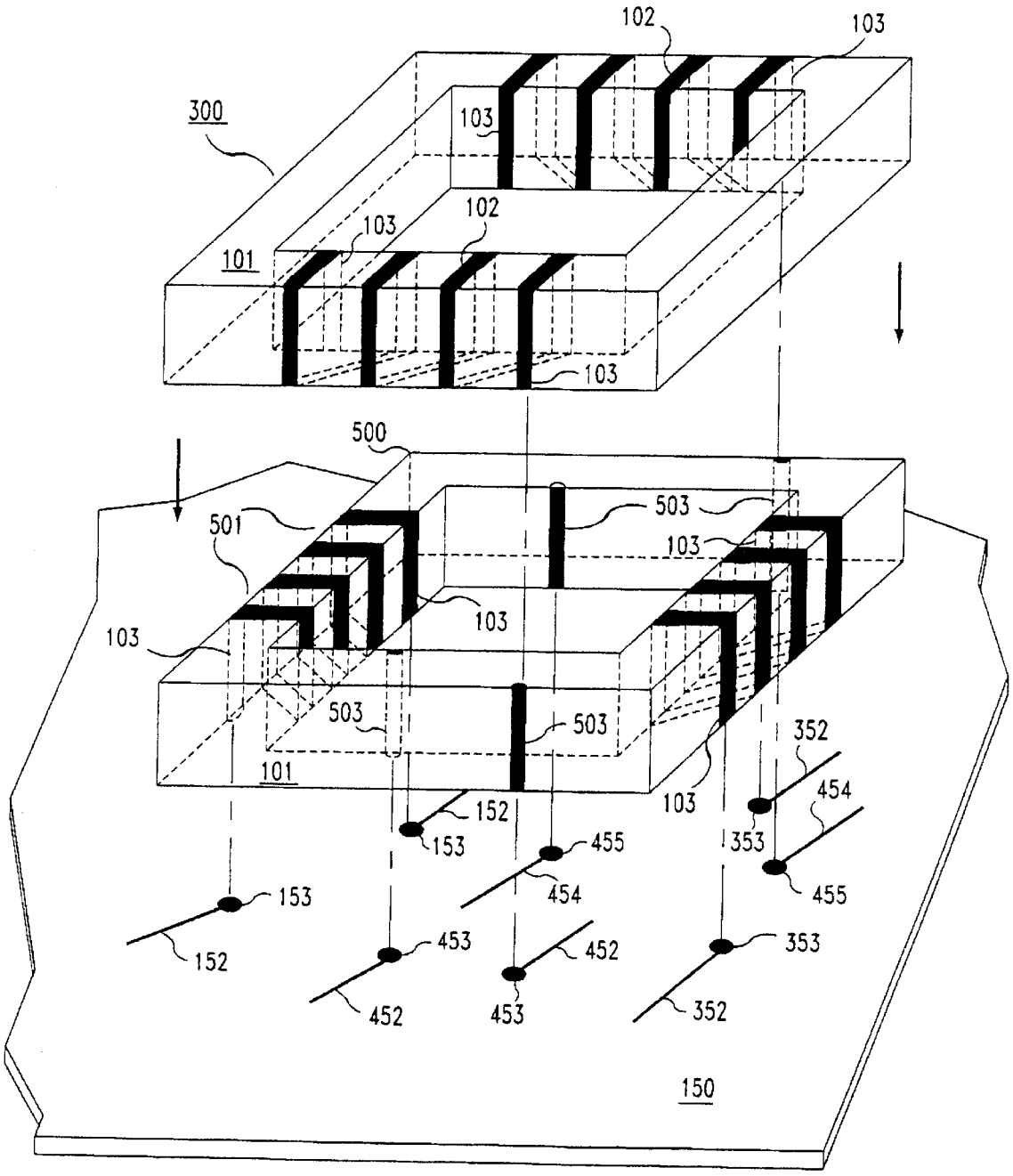
FIG. 4 is an exploded perspective view of PC board surface-mounted stacked ferrite chokes implementing a fourth illustrative embodiment of the invention.

Because of the need to place as many components on as small a PC board 150 as possible in order to keep circuit size small, "real estate" on PC board 150 is valuable and must be conserved. Stacking of components, so that multiple components take up no more real estate than one, is therefore desirable. FIG. 4 shows a stackable configuration of two EMI chokes 300 and 500. Top choke 300 is a duplicate of the choke shown in FIG. 3; bottom choke 500 is also substantially a duplicate of the one shown in FIG. 3, but in addition it defines two pairs of metallized vias 503, one pair in each side of squareoid 101 that does not define a winding. As shown, vias 503 are separate from the windings of bottom choke 500. The two chokes 300 and 500 are positioned orthogonally and face-to-face with respect to each other, and vias 503 of choke 500 connect with vias 103 of choke 300. Striplines 152 and 352 of PC board 150 connect to vias 103 of choke 500. In addition, PC board 150 defines striplines 452 and 454 and corresponding pairs of landing pads 453 and 455 that connect to vias 503 of choke 500. Vias 503 of choke 500 thus provide an electrical connection between choke 300 and PC board 150. Because of the orthogonal orientation of their windings, chokes 300 and 500 do not electromagnetically interfere with each other.

Of course, various changes and modifications to the illustrative embodiments described above will be apparent to those skilled in the art. These changes and modifications can be made without departing from the spirit and the scope of the invention and without diminishing its attendant advantages. It is therefore intended that such changes and modifications be covered by the following claims.

The invention claimed is:

1. A filter comprising:

a ferrite core having a surface;

a first conductive winding defined by a first portion of the surface and wound in a clockwise direction, with ends of the first winding defined by the surface and serving to connect and to mount the filter to a circuit board;

a second conductive winding defined by a second portion of the surface and wound in a counter-clockwise direction, with ends of the second winding defined by the surface and serving to connect and to mount the filter to the circuit board; and a plurality of conductive vias separate from the first and the second conductive windings, at least partly embedded in the ferrite core and opening onto the surface, for connecting to ends of windings of a second filter mounted on the ferrite core and for connecting the windings of the second filter to the circuit board.

2. The filter of claim 1 wherein:

the ends of each winding comprise conductive vias at least partly embedded in the ferrite core and opening onto the surface and serving at the surface to connect and to mount the filter to the circuit board.

3. The filter of claim 1 wherein:

the ferrite core has a hollow rectangle shape.

4. The filter of claim 1 wherein:

the windings are axially substantially parallel to each other.

5. The filter of claim 1 wherein:

each winding comprises a conductive stripline formed on the surface of the ferrite core.

6. The filter of claim 1 wherein:

the plurality of conductive vias are positioned such that the windings of the second filter are positioned orthogonally to the first and the second windings when the second filter is mounted on the ferrite core and the windings of the second filter are connected to the plurality of conductive vias.

7. An inductor comprising:

a ferrite core having a surface;

a conductive winding defined by the surface, with ends of the winding defined by the surface and serving to connect and to mount the inductor to a circuit board; and a plurality of conductive vias separate from the conductive winding, at least partly embedded in the ferrite core and opening onto the surface, for connecting to ends of a winding of a second inductor mounted on the ferrite core and for connecting the winding of the second inductor to the circuit board.

8. The inductor of claim 7 wherein:

the plurality of conductive vias are positioned such that the winding of the second inductor is positioned orthogonally to the winding of the ferrite core when the second inductor is mounted on the ferrite core and the winding of the second inductor is connected to the plurality of conductive vias.

9. The inductor of claim 7 wherein:

the winding ends of the winding of the ferrite core comprise conductive vias at least partly embedded in the ferrite core and opening onto the surface and serving at the surface to connect and to mount the inductor to the circuit board.

10. The inductor of claim 7 wherein:

the ferrite core has a hollow rectangle shape.

11. The inductor of claim 7 wherein: the winding of the ferrite core comprises a conductive line deposited on the surface of the ferrite core.

12. The inductor of claim 7 wherein:

the winding of the ferrite core comprises a first winding portion and a second winding portion each defined by the surface, with ends of both winding portions defined by the surface and serving to connect and to mount the inductor to a circuit board which defines a conductor that connects an end of the first winding portion with an end of the second winding portion of mounted said inductor to form a single inductor winding from the first and the second winding portions.

13. The inductor of claim 7 wherein:

the winding of the ferrite core comprises a plurality of mutually unconnected conductive winding segments defined by the surface, the segments having ends defined by the surface and serving to mount the inductor to a circuit board and to connect the segments to conductors defined by the circuit board and laid out in a pattern such that the conductors interconnect at least some of the winding segments of mounted said inductor to form an inductor winding.

14. The inductor of claim 13 wherein:

the ends of the winding segments comprise conductive vias at least partly embedded in the ferrite core and opening onto the surface and serving at the surface to connect and to mount the inductor to the circuit board.

15. The inductor of claim 13 wherein:

each winding segment comprises a pair of the conductive vias interconnected by a conductive line formed on the surface of the ferrite core.

16. The inductor of claim 13 wherein:

the ferrite core has a hollow rectangle shape.

* * * * *